United States Patent [19]

Wecker

[11] Patent Number: 4,854,979

[45] Date of Patent: Aug. 8, 1989

[54] METHOD FOR THE MANUFACTURE OF AN ANISOTROPIC MAGNET MATERIAL ON THE BASIS OF FE, B AND A RARE-EARTH METAL

[75] Inventor: Joachim Wecker, Erlangen, Fed. Rep. of Germany

[73] Assignee: Siemens Aktiengesellschaft, Berlin and Munich, Fed. Rep. of Germany

[21] Appl. No.: 170,297

[22] Filed: Mar. 18, 1988

[30] Foreign Application Priority Data

Mar. 20, 1987 [DE] Fed. Rep. of Germany ..... 3709140

[51] Int. Cl.[4] ..... H01F 41/02

[52] U.S. Cl. ..... 148/103; 148/104; 148/108; 164/463; 164/477

[58] Field of Search ..... 148/103, 104, 108; 164/463, 477

[56] References Cited

U.S. PATENT DOCUMENTS 4,402,770 9/1983 Koon ..... 148/302

FOREIGN PATENT DOCUMENTS 0126179 9/1983 European Pat. Off. .
0144112 2/1984 European Pat. Off. .
108474 5/1984 European Pat. Off. ..... 148/302
197843 10/1985 Japan .

OTHER PUBLICATIONS

Croat, J. J., Research Publication GMR-4080, "Permanent Magnet Properties of Rapidly Quenched Rare--Earth Iron Alloys", Jul. 1982.

Becker, J. "Rapidly Quenched Metals for Permanent Magnet Materials", *Journal of Applied Physics,* 55(6), Mar. 15, 1984.

European Search Report RS-78009 DE.

Thermal Effects of Moderate Substitutions of Cobalt for Iron in $Fe_{76}PR_{16}B_8$, 320 *Applied Physics Letters* No. 9 (May, 1984).

Hot-Pressed Neodymium-Iron-Boron Magnets, *Applied Physics Letters,* vol. 96, No. 3 (Apr. 15, 1985).

Magnet Properties of the $Nd_2(Fe_{1x}Co_x)_{14}$ System *Applied Physics Letters,* vol. 96, No. 3 (Feb. 1, 1985).

Spin Reorientations in $R_2FE_{14-x}Co_xB$ Systems (R=Pr, Nd and Er) *Journal of Magnetism and Magnetic Materials,* 65 (1987) 139-144.

*Zeitschrift fuer metallkunde,* vol. 69, No. 4, (1978) (German).

*Primary Examiner*—L. Dewayne Rutledge
*Assistant Examiner*—George Wyszomierski
*Attorney, Agent, or Firm*—Kenyon & Kenyon

[57] ABSTRACT

An anisotropic magnetic material formed from iron, boron and a rare-earth metal is prepared by the rapid solidification of an alloy melt of the desired composition and subsequently treated to generate magnetic anisotropy. The materials attain comparatively higher coercivity field strengths. A preliminary alloy is first prepared with the material components and cobalt is added to the alloy in such an amount that the crystallization temperature of the corresponding amorphous material system is below the Curie temperature of the crystallizing $SE_2$ (Fe, Co)$_{14}$B- phase. An intermediate product with amorphous structure is then developed from the melt of the preliminary alloy using a rapid solidification technique. Thereafter, a crystallization of the intermediate product is performed using a heat treatment at a temperature that is above the crystallization temperature but below the Curie Temperature in the presence of an external d-c magnetic field to generate the magnetic anisotropy. The particles involved can be aligned and mechanically fixed after the crystallization.

19 Claims, 1 Drawing Sheet

METHOD FOR THE MANUFACTURE OF AN ANISOTROPIC MAGNET MATERIAL ON THE BASIS OF FE, B AND A RARE-EARTH METAL

BACKGROUND OF THE INVENTION

1. Field of the Invention

The present invention relates to a method for manufacturing an anisotropic magnet material from material having at least the three components iron (fe), boron (b) and a rare-earth metal (SE). This method performs a rapid solidification (quenching) of an alloy melt of the desired composition and subsequently treats the alloy to generate magnetic anisotropy.

2. Description of Related Art

The Nd-Fe-B magnet materials show remanence values and energy densities at room temperature which are distinctly greater than those of the known alloys on an Sm-Co basis. It should therefore be expected that these materials can replace conventional Sm-Co materials in many applications. The excellent magnetic properties of this three component system are based on the tetragonal intermetallic phase $Nd_2Fe_{14}B$. This phase, sometimes also called theta phase, has a uniaxial crystal anisotropy that gives an anisotropy field $H_A$ of approximately 75 kOe at 300° K.

Anisotropic Nd-Fe-B magnet materials are frequently prepared by powder metallurgy (see European Patent Application No. 0 126,179). According to this method, an alloy of the desired composition is first ground until the powder grains have the size of single domain (span) particles between 2 and 4 μm. The powder grains are then aligned in a magnetic field, precompacted by isostatic pressing and then sintered to form a high-density body. The magnetic properties are then optimized by a final heat treatment.

An alternative method, such as disclosed in European Patent Application No. 0,144,112, makes isoptropic tapes of the desired composition by first rapidly solidifying an alloy melt of the desired composition. These tapes have a fine-crystalline structure. The tapes are then compacted by compression at temperatures of about 700° C. to form a dense isotropic body. Subsequent hot deformation at about 700° C. by approximately 50% leads to an anisotropic texture with the c-direction being the magnetically easy axis parallel to the direction of the pressure (see also "Appl. Phys. Lett." 46 (8), Apr. 15, 1985, pages 790 and 791).

Technical magnets have a general composition of the type $Nd_{15}Fe_{77}B_8$ and are in a three-phase equilibrium between the magnetically hard $Nd_2Fe_{14}$ B-phase, a phase $Nd_{1.14}Fe_4B_4$-phase rich in B, and a solid solution (mixed crystal) rich in Nd. The foreign phases are necessary here in part to optimize the structure-dependent coercitive properties.

Despite their superior magnetic properties, the use of Nd-Fe-B materials is strictly limited by its low Curie temperature $T_c$ of about 315° C. The remanence and coercivity field strengths drastically decrease with increasing temperature and fall below the values of optimized Sm-Co magnet material. Attempts have been made to increase the Curie temperature by partially substituting Fe with Co so as to increase the span between the Curie and the use temperature (see "Appl. Phys. Lett." 46 (3), Feb. 1, 1985, pages 308 to 310). However, the results on sintered magnets show that Co additions cause the coercitivity field strength to decrease at the same time. Ultimately, the Co substitution produces no improvement. (see "IEEE Transactions Magn.", MAG-21, 1985, pages 1952 to 1954).

SUMMARY OF THE INVENTION

The present invention further develops the method of the type mentioned in the field of the invention produce anisotropic magnet materials so that the material components Fe, B and a rare-earth metal exhibit a larger coercivity field strength.

In the ternary system Nd-Fe-B, the inability to adjust a preferred anisotropy by a heat treatment of the initially amorphous alloy in a magnetic field results from the low Curie temperature $T_c$ of about 315° C. as compared to the crystallization temperature $T_k$ of about 550° C. It is known that additions of Co increase the Curie temperature with magnets with an Nd-Fe-B basis produced by powder metallurgy. It is also known that the coercitivity becomes worse at the same time. An improvement of the temperature stability by Co alone is therefore not possible. The present invention, however, is based on the insight that the $Nd_2(Fe_{l-x}Co_x)_{14}B$-phase formed in the early states of a crystallization of the corresponding amorphous alloy has a Curie temperature $T_c$ comparable to the equilibrium phase. This result is surprising because metastable phases with a different structure or a different composition can be generated first during crystallization. These metastable phases have physical properties that differ with respect to structure and concentration from the phase present in the thermodynamic equilibrium. The X-ray spectra of this compound show that Co is actually incorporated into the $Nd_2Fe_{14}B$ phase. The X-ray spectra specifically show a characteristic shift of the reflection positions toward larger angles with increasing Co content, such as can be expected from the decrease of the lattice constant of the tetragonal phase caused by the incorporation of Co (see the cited literature reference from "Appl. Phys. Lett." 46,3). In addition, adding Co further increases the influence on the coercivity field strength through a suitable choice of the overall composition of the material systems relative to sintered materials. Remanence also possibly increases. Thus, for example, an initially amorphous $Nd_{17.5}(Fe_{0.7}Co_{0.3})_{67.5}B_{15}$ material reaches a coercivity fields of 20 KOe compared to 16 kOe) of a corresponding Co-free material.

DETAILED DESCRIPTION

Figure 1:
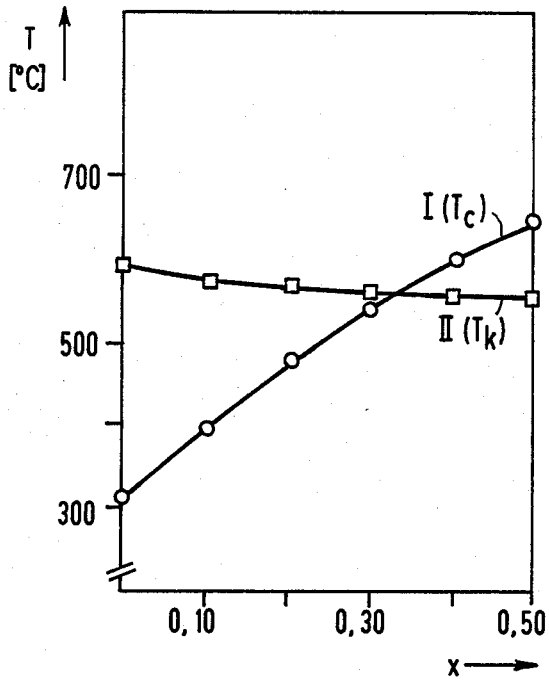
FIG. 1 shows the dependence of the Curie temperature and the crystallization temperature of the Co concentration for the material Nd-(Fe, Co)-B.

The example is based on a magnet material of the 4-material RE (Fe, Co)-B. Nd is chosen as the rare-earth metal SE. To manufacture the present invention, a magnetic material with sufficient purity and having the composition $Nd_{15}(Fe_{l-x}Co_x)_{77}B_8$ with $0.1 \leqq x \leqq 0.6$, such as the alloy $Nd_{15}(Fe_{0.7}Co_{0.3})_{77}B_8$, is chosen as the starting material. The components are inductively melted in the desired ratio in an argon atmosphere purified by Ti to form a preliminary alloy. Pyrolytic BN or $Al_2O_3$ crucibles are used. Melting in an arc furnace also might be used to form the preliminary alloy.

An amorphous structure is generated by rapidly solidifying the proper alloy melt using a known method called melt spinning. This method is known from the manufacture of amorphous metal alloys (see, for instance, "Zeitschrift fuer Metallkunde", Vol. 69, 1978, No. 4, pages 212 to 220). The preliminary alloy is additionally melted at high frequency in a protective gas such as argon or in a vacuum in a quartz crucible and is then sprayed through a nozzle onto a rapidly-rotating copper drum. The substrate velocity, i.e. the speed of rotation of the copper drum, is typically above 30 m/sec to obtain the required cooling rate of more than $10^6$K/sec. Crystallization is thus suppressed and the desired amorphous state is obtained. The amorphous phase is characterized by a diffused X-ray refraction diagram and an asymmetrical hysteresis loop having coercivity field strengths below 100 Oe.

The intermediate product obtained in this manner has the form of tape. It is subsequently comminuted to form smaller tape sections or powders. The particles developed thereby are melted in, for example, quartz tubes in an argon atmosphere, optionally in the presence of additional getter materials such as Zr, to bind residual oxygen.

The intermediate product prepared in this manner is subsequently crystallized through suitable heat treatment. The temperature is selected to be above the crystallization temperature $T_k$, but below the Curie temperature $T_c$. Thus, for example, a temperature of about 500° C. for a period of 120 minutes can be provided for the special alloy $Nd_{15}(Fe_{0.7}Co_{0.3})_{77}B_8$ because the Curie temperature of this alloy is approximately 525° C.. This heat treatment is performed in a d-c magnetic field in order to adjust the desired magnetic anisotropy. Advantageously, a value between 0.5 and 100kOe is chosen for the field strength. The temperature to be chosen must be below the temperature $T_s$ at which the uniaxial preference direction changes into a planar reference plane (see "Journ. of Magnetism and Magn. Mat.", Vol. 65, 1987, pages 139 to 144).

Finally, the powder crystallized in this manner is aligned in an additional external d-c field magnetic. The field strength of this alignment field can be substantially smaller than the field applied during the crystallization process and can be, for example, at least 1, but preferably at least 5 kOe. Simultaneously with the aligning, the powder particles will be mechanically fixed by, for example, pouringin fast hardening synthetic resin. The structure of the special anisotropic magnet material obtained in this way can be used to construct magnets.

An alternate embodiment aligns the crystallized particles in a magnetic field while simultaneously being compacted using mechanical pressing methods to form a dense body. Here, a work piece with a desired geometry can first be pressed from the amorphous material so that the field crystallization is carried out only subsequently. This process has the advantage that the material can be given a complicated geometry using special configurations of the magnetic field. Magnetic ring bodies that have a radial preference direction can thus be made.

The method according to the present invention can be used for any desired alloy concentration as long as the magnetically hard phase $Nd_2(Fe, Co)_{14}B$ is at least predominantly generated in the crystallization. The Co concentration, referred to as the Fe content, should be between 0.1 and 0.60, and preferably between 0.15 and 0.5. This concentration results in Curie temperatures between 430 and 630° C..

The corresponding temperature conditions for the material $Nd_{15}(Fe_{l-x}Co_x)_{77}B_8$ is shown in FIG. 1. The abscissa of FIG. 1 shows the Co concentration x as the substituted Fe content. The corresponding temperatures T are plotted in degree C. Curve I represents the Curie temperature $T_c$ of the crystallizing $Nd_2(Fe, Co)_{14}$-B phase, and curve II represents the crystallization temperature $T_k$ of corresponding amorphous tapes for a heating rate of 40° K./min. According to the present invention the heat treatment for the crystallization takes place above the crystallization temperature $T_k$ but below the Curie temperature $T_c$. Thus, only Co concentrations with x greater than 0.3 are possible due to the annealing condition provided. However, if smaller heating rates are chosen or if the crystallization is carried out isothermally for more extended annealing times, then curve II slides more downward so that then the required temperature conditions can be maintained with correspondingly low concentrations.

Generally, in the method according to the present invention the desired theta phase of the four-material system $RE_x(Fe, Co)_yB_z$ occurs if a composition of this system is chosen so that $10 \leqq x \leqq 30$, $60 \leqq y \leqq 85$ and $3 \leqq z \leqq 20$. Preferably, x, y, and z should fulfill the following relationships: $11 \leqq x \leqq 20$, $65 \leqq y \leqq 80$ and $5 \leqq z \leqq 20$. The symbol RE here represents at least one rare-earth metal having an atomic number between 58 and 66, inclusive.

Figure 2:
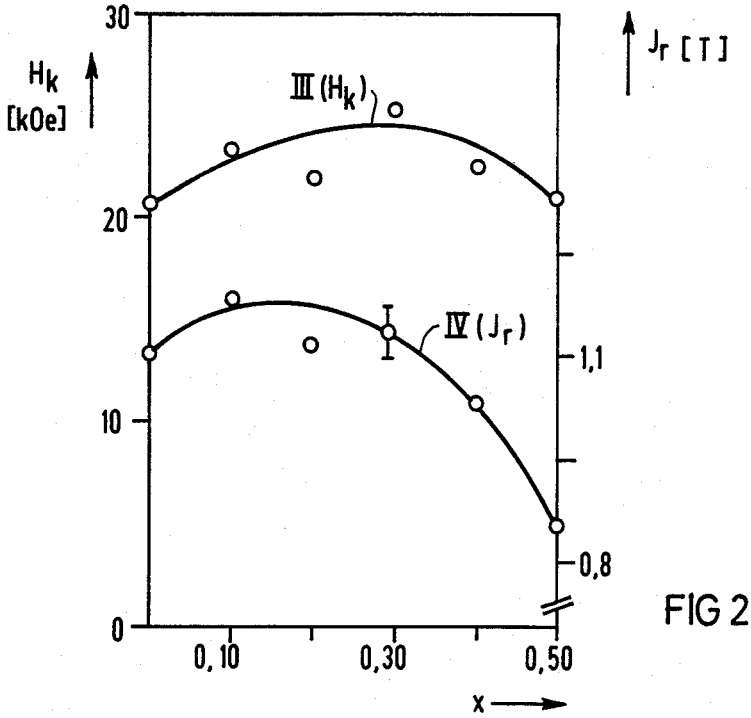
FIG. 2 shows the coercivity field strength and the remanence as a function of the Co concentration for the material shown in FIG. 1.

FIG. 2 shows the coercivity field strength $H_k$(in kOe attainable with the method according to the present invention. The remanence $J_r$ is also shown as a function of the concentration x (substituted Fe content) of rapidly solidified $Nd_{15}(Fe_{l-x}Co_x)_{77}B_8$-tapes. Curve III shows the coercivity field strength relationships. Curve IV shows the remanence relations. FIG. 2 shows that a substitution of up to about 50% Co for Fe leads to practically no degradation of the coercivity fields. This result is contrary to the results obtained on sintered magnets. For a Co content of 30%, even $H_k$ values of 25 kOe are measured. The remanence values shown by curve IV, in contrast, decrease for samples rich in cobalt due at least in part to a decrease of the saturation magnetization by about 10% for Co concentrations x above 0.2.

It was assumed in the example shown that the rare earth metal is Nd. Another rare-earth metal such as prasaeodymius (Pr) can be chosen equally well. It is also possible to at least partially substitute a lighter rare-earth metal with a heavier rare-earth metal such as dysprosium (Dy) to achieve higher coercivity field strengths.

The Fe component can optionally be partially substituted by another metallic element such as aluminum (Al).

In addition, other known rapid-solidification techniques can be used to generate an amorphous structure of the intermediate product such as the development of thin layers by sputtering techniques or the preparation of amorphous metal powders by atomization (nozzle spraying). In the latter case the special comminution step present in the development of amorphous tapes is not required.

The method of the present invention is not limited to intermediate products in particle or powder form. Thus, for example, the thin layers prepared in accordance with the present invention can provide the construction of magnetic heads in a data storage apparatus.

What is claimed is:

1. A method for manufacturing anisotropic magnetic material of a material system, comprising the steps of:

preparing an alloy melt from at least three material compounds comprising iron (Fe), boron (B) and a rareearth metal (RE), said alloy melt containing a further material component consisting of cobalt (Co);

forming an intermediate product having an amorphous structure by means of rapid solidification of said alloy melt, said cobalt of said amorphous material system being in such an amount that said corresponding amorphous material has a crystallization temperature below the Curie temperature of a crystallizing $RE_2$ (Fe, Co)$_{14}$ of said material system;

developing said $RE_2$ (Fe, Co)$_{14}$B phase of said material system in the presence of an external d-c magnetic field to form a magnetocrystalline anisotropy by means of heat treating said intermediate product at a heat treatment temperature above said crystallization temperature and below said Curie temperature, whereby said intermediate product is crystallized, said heat treating temperature being below a predetermined transition temperature at which the uniaxial preference direction of the magnetocrystalline anisotropy changes into a planar reference plane.

2. A method as claimed in claim 1, wherein said rareearth metal is selected from the group consisting of neodymium (Nd) and praseodymium (Pr).

3. A method as claimed in claim 1, wherein the ratio of Co to Fe is between 0.1 and 0.6.

4. A method as claimed in claim 3, wherein the ratio of Co to Fe is between 0.15 and 0.5.

5. A method as claimed in claim 1, wherein a further rare-earth metal partially substitutes for the rare-earth metal in said preliminary alloy.

6. A method as claimed in claim 5, wherein said further rare-earth metal is dysprosium.

7. A method as claimed in claim 1, wherein another metal at least partially substitutes for the Fe in said preliminary alloy.

8. A method as claimed in claim 7, wherein said another metal is aluminum (Al).

9. A method as claimed in claim 1, wherein said material system comprises $RE_x$(Fe, Co)$_y$B$_z$, where $10 = x = 30$, $60 = y = 85$ and $3 = z = 20$.

10. A method as claimed in claim 9, wherein said material system has an overall composition of $11 = x = 20$; $65 = y = 80$ and $5 = z = 20$.

11. A method as claimed in claim 10, wherein said amorphous intermediate product has a form selected from the group consisting of tape, thin layers, or a metal powder.

12. A method as claimed in claim 11, further comprising the step of comminuting said intermediate product to form particles.

13. A method as claimed in claim 1, wherein said external magnetic field has a field strength between 0.5 and 100 kOe.

14. A method as claimed in claim 1, further comprising the steps of:

aligning particles of the crystallized intermediate product after said crystallization; and mechanically fixing said particles to form a structure.

15. A method as claimed in claim 14, wherein said step of aligning said particles includes the step of applying an external d-c magnetic alignment field.

16. A method as claimed in claim 15, wherein said magnetic alignment field has a field strength of at least 1 kOe.

17. A method as claimed in claim 16, wherein said field strength is at least 5 kOe.

18. A method as claimed in claim 14, wherein the step of mechanically fixing said particles includes the step of mechanically fixing said particles with a hardenable synthetic material.

19. A method as claimed in claim 18, wherein said step of mechanically fixing said particles include the step of pressing said particles.

* * * * *